US009085426B2

(12) United States Patent
Fujii et al.

(10) Patent No.: US 9,085,426 B2
(45) Date of Patent: Jul. 21, 2015

(54) FEEDING DEVICE AND IMAGE FORMING APPARATUS

(71) Applicants: Ikuo Fujii, Osaka (JP); Toshio Matsuyama, Koutou-ku (JP); Ippei Kimura, Osaka (JP); Mizuna Tanaka, Osaka (JP); Hirofumi Horita, Osaka (JP); Takamitsu Ikematsu, Osaka (JP); Kaoru Tada, Osaka (JP)

(72) Inventors: Ikuo Fujii, Osaka (JP); Yasuo Matsuyama, Hyogo (JP); Ippei Kimura, Osaka (JP); Mizuna Tanaka, Osaka (JP); Hirofumi Horita, Osaka (JP); Takamitsu Ikematsu, Osaka (JP); Kaoru Tada, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/025,184

(22) Filed: Sep. 12, 2013

(65) Prior Publication Data

US 2014/0077444 A1 Mar. 20, 2014

(30) Foreign Application Priority Data

Sep. 13, 2012 (JP) ..... 2012-201665

(51) Int. Cl.
*B65H 1/00* (2006.01)

(52) U.S. Cl.
CPC ..... *B65H 1/00* (2013.01)

(58) Field of Classification Search
CPC ..... B65H 1/266; B65H 2511/10; B65H 2511/212; B65H 2511/416; B65H 2551/14
USPC ..... 271/145, 171
See application file for complete search history.

(56) References Cited

U.S. PATENT DOCUMENTS

| | | | | | |
|---|---|---|---|---|---|
| 5,539,512 | A | * | 7/1996 | Mui | 399/376 |
| 5,572,310 | A | * | 11/1996 | Hoberock et al. | 399/370 |
| 5,655,764 | A | * | 8/1997 | Ota et al. | 271/171 |
| 5,839,047 | A | | 11/1998 | Hirabayashi et al. | |
| 5,927,707 | A | * | 7/1999 | Miura | 271/171 |
| 5,975,515 | A | * | 11/1999 | Capri et al. | 271/9.11 |

(Continued)

FOREIGN PATENT DOCUMENTS

| | | |
|---|---|---|
| JP | 2595860 | 1/1997 |
| JP | 09-290929 | 11/1997 |

(Continued)

*Primary Examiner* — Patrick Cicchino
(74) *Attorney, Agent, or Firm* — Harness, Dickey & Pierce, P.L.C.

(57) ABSTRACT

A feeding device includes a paper feed tray, a detector on an image forming apparatus main body, a control member rotatably supported by the paper feed tray, and spacers. The detector includes movable pieces and contact points corresponding to the movable piece, and switches each contact point by the position of the corresponding movable piece. The control member includes a control surface formed on its outer circumferential surface with projecting and recessed portions. The projecting and recessed portions are disposed in a pattern corresponding to rotation angles in an area of the control surface facing the movable pieces. Controlling the positions of the movable pieces according to the pattern encodes paper size. Each movable piece is lined in the circumferential direction facing the control surface. The outer circumferential surface of the projecting portions is formed in a cylindrical surface shape centering around the rotational axis of the control member.

13 Claims, 10 Drawing Sheets

(56) References Cited

U.S. PATENT DOCUMENTS

| | | | | |
|---|---|---|---|---|
| 6,254,085 | B1 * | 7/2001 | Kang | 271/171 |
| 6,826,383 | B2 * | 11/2004 | Yano | 399/389 |
| 2004/0047663 | A1 * | 3/2004 | Yano | 399/389 |
| 2005/0196211 | A1 * | 9/2005 | Miki | 399/389 |
| 2012/0061907 | A1 | 3/2012 | Matsuyama et al. | |
| 2012/0063829 | A1 | 3/2012 | Matsuyama et al. | |
| 2012/0299237 | A1 * | 11/2012 | Mizuguchi et al. | 271/145 |
| 2013/0134658 | A1 * | 5/2013 | Nagai | 271/171 |
| 2013/0200562 | A1 * | 8/2013 | Matsuyama et al. | 271/3.14 |

FOREIGN PATENT DOCUMENTS

| | | |
|---|---|---|
| JP | 11-059920 | 3/1999 |
| JP | 2009-073664 | 4/2009 |

* cited by examiner

| SIZE NO. | MOVABLE PIECE NO. | | | STANDARD PAPER SIZE NAMES |
|---|---|---|---|---|
| | 1 | 2 | 3 | |
| 1 | 1 | 1 | 1 | A3 [T] |
| 2 | 1 | 1 | 0 | A4 [Y] |
| 3 | 1 | 0 | 0 | LETTER [Y] |
| 4 | 0 | 0 | 0 | NO TRAY PRESENT |
| 5 | 0 | 0 | 1 | LEGAL [T] |
| 6 | 0 | 1 | 0 | A5 [T] |
| 7 | 1 | 0 | 1 | B5 [T] |
| 8 | 0 | 1 | 1 | * (NON-STANDARD) |

| SIZE NO. | MOVABLE PIECE NO. | | | | STANDARD PAPER SIZE NAMES |
|---|---|---|---|---|---|
| | 1 | 2 | 3 | 4 | |
| 1 | 1 | 1 | 1 | 1 | A3 [T] |
| 2 | 1 | 1 | 1 | 0 | LETTER [Y] |
| 3 | 1 | 1 | 0 | 1 | LETTER [T] |
| 4 | 1 | 0 | 1 | 0 | A4 [T] |
| 5 | 0 | 1 | 0 | 1 | A4 [Y] |
| 6 | 1 | 0 | 1 | 1 | A6 [T] |
| 7 | 0 | 1 | 1 | 0 | DLT [T] |
| 8 | 1 | 1 | 0 | 0 | LEGAL [T] |
| 9 | 1 | 0 | 0 | 0 | * (NON-STANDARD) |
| 10 | 0 | 0 | 0 | 0 | NO TRAY PRESENT |
| 11 | 0 | 0 | 0 | 1 | A5 [T] |
| 12 | 0 | 0 | 1 | 0 | A5 [Y] |
| 13 | 0 | 1 | 0 | 0 | B4 [T] |
| 14 | 1 | 0 | 0 | 1 | B5 [T] |
| 15 | 0 | 0 | 1 | 1 | B5 [Y] |
| 16 | 0 | 1 | 1 | 1 | B6 [T] |

FEEDING DEVICE AND IMAGE FORMING APPARATUS

CROSS-REFERENCE TO RELATED APPLICATIONS

The present application claims priority to and incorporates by reference the entire contents of Japanese Patent Application No. 2012-201665 filed in Japan on Sep. 13, 2012.

BACKGROUND OF THE INVENTION

1. Field of the Invention

The present invention relates to a feeding device that feeds recording media and an image forming apparatus such as a laser printer, a digital copying machine, and a facsimile provided with the feeding device.

2. Description of the Related Art

A feeding device in an image forming apparatus can store therein recording paper in a stacking manner and is provided with a single- or multiple-stage paper feed tray (or paper cassette) that is detachable with respect to the main body of the image forming apparatus. The paper feed tray is attached to or detached from the image forming apparatus main body typically via an opening provided on one surface of the image forming apparatus.

The image forming apparatus of this type transmits information of the size of paper stored in the paper feed tray to a controller in the image forming apparatus main body so that the copying or printing is correctly performed. As a mechanism to simply transmit the paper size information to the controller, known are some mechanisms in which a rotary dial is provided on a front panel of a paper feed tray, and a user operates the dial to encode and transmit the paper size to the controller (Japanese Laid-open Patent Publication No. 6-100198, Japanese Laid-open Patent Publication No. 11-59920, Japanese Laid-open Patent Publication No. 2009-73664, and Japanese Laid-open Patent Publication No. 9-290929).

As a mechanism of this type, Japanese Laid-open Patent Publication No. 6-100198 discloses a structure in which pressing components in a projecting shape as an encoder are attached on a reverse face of a disc shaped indicator plate rotatably supported on a paper cassette, and when the paper cassette is attached to the main body, a plurality of switches provided on the main body are selectively pressed by the pressing components, thereby detecting the paper size. Japanese Laid-open Patent Publication No. 11-59920 discloses a similar structure.

Furthermore, Japanese Laid-open Patent Publication No. 2009-73664 discloses a structure in which a columnar dial is rotatably disposed on a paper feed tray and a plurality of cams are provided on an outer circumferential surface of the dial at different positions in height and in the circumferential direction, and the attaching operation of the paper feed tray makes the cams selectively press size detecting switches provided on the main body side to detect the paper size. Moreover, Japanese Laid-open Patent Publication No. 9-290929 discloses a structure in which a plurality of peaks are projected in the radial direction of a size indicator plate and rotating the size indicator plate makes the peaks contact switches to activate sensors.

The general-purpose detecting sensors are structured with switches lined up in a row, and thus in the mechanism in which the switches are disposed facing the reverse face of the disc shaped indicator plate as in Japanese Laid-open Patent Publication No. 6-100198 and Japanese Laid-open Patent Publication No. 11-59920, it is unavoidable that the diameter of the indicator plate becomes large. Consequently, the installation space for the indicator plate is restricted, and the flexibility of design is lowered. While Japanese Laid-open Patent Publication No. 6-100198 discloses a usage example of sensors in which switches are lined in two rows, such sensors are not generic and thus lead to a cost increase.

Furthermore, the structure in Japanese Laid-open Patent Publication No. 2009-73664 needs to provide the same number of rows of cams as the number of switches for the sensors on the outer circumferential surface of the columnar dial in the axial direction, and thus the size of the dial in the axial direction tends to be large. The structure in Japanese Laid-open Patent Publication No. 9-290929 requires, in addition to the space for the size indicator plate, the space for the rotational locus of the peaks when rotating the size indicator plate, and thus the installation space is similarly restricted.

Therefore, there is a need to achieve the downsizing of and lowering the cost of a mechanism that encodes size information of a recording medium.

SUMMARY OF THE INVENTION

According to an embodiment, there is provided a feeding device that includes a media storage unit that stores therein recording media and is attachable to and detachable from a main body of an image forming apparatus; a detector that is provided on the main body of the image forming apparatus, includes a plurality of movable pieces and a plurality of contact points corresponding to the respective movable pieces, and switches to open or close each of the contact points in accordance with a position of the corresponding movable piece; and a control member that is rotatably supported by the media storage unit, includes a control surface on its outer circumferential surface with recessed portions and projecting portions provided in a direction of rotation, and is positioned at given rotation angles respectively corresponding to sizes of the recording media stored in the media storage unit. The projecting portions and the recessed portions are disposed in a pattern corresponding to the rotation angles in an area of the control surface facing the movable pieces. The control member controls the position of each of the movable pieces in accordance with the pattern so as to encode the media size. The control member is formed with the control surface on an outer circumferential surface thereof. Each of the movable pieces is disposed to face the control surface. An outer circumferential surface of each of the projecting portions is formed in a shape having a curvature radius greater than a radius of rotation thereof.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
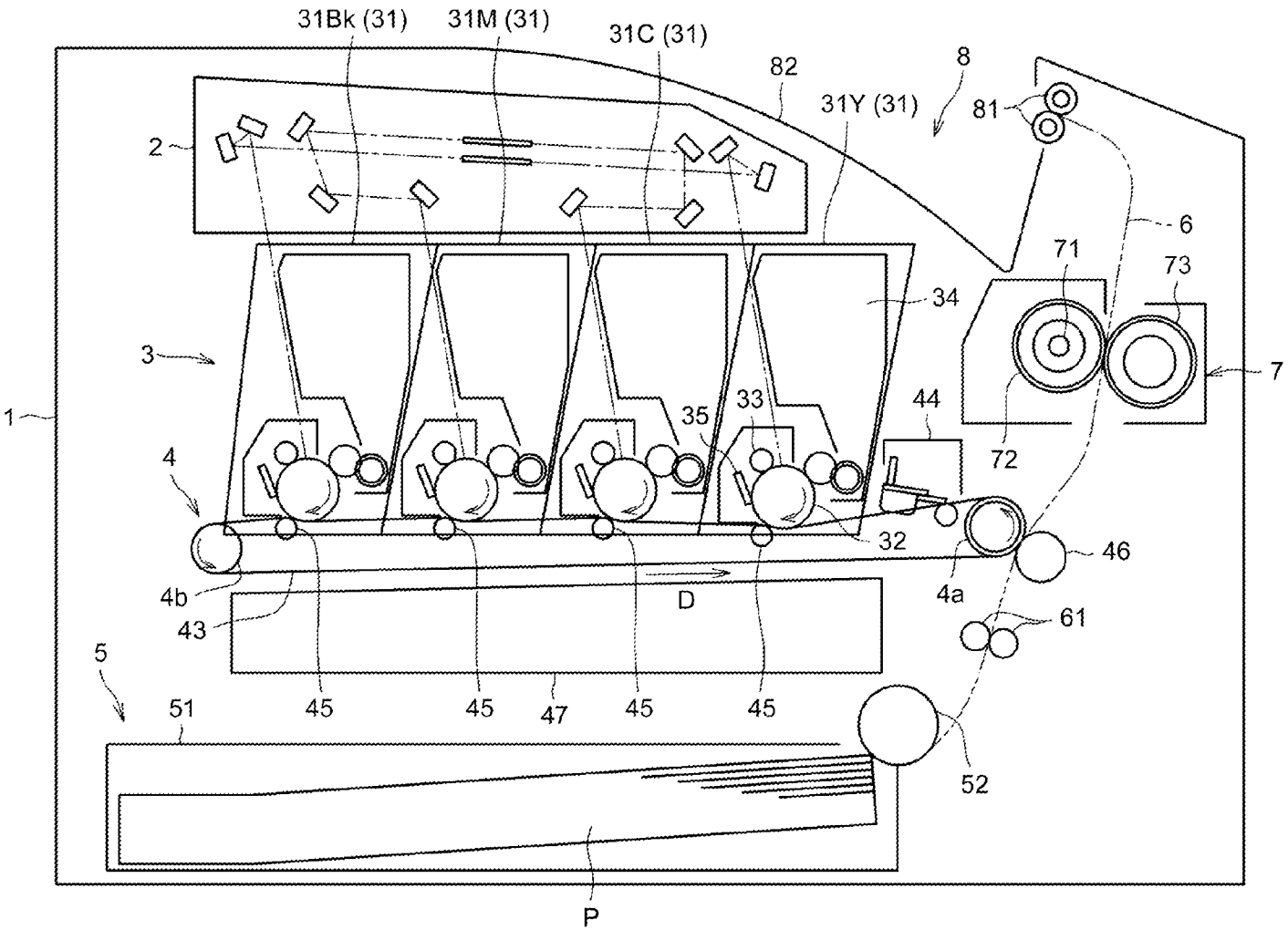
FIG. 1 is a sectional view illustrating an overall structure of an image forming apparatus including a feeding device.

Based on the accompanying drawings, the following describes exemplary embodiments of the present invention. In the respective drawings for explaining the embodiments of the present invention, constituent elements such as members and components having the same or a similar function or shape will be given the same reference numerals whenever possible to distinguish, and once described, the redundant explanation thereof will be omitted.

With reference to FIG. 1, the following first describes an overall structure and operation of a color laser printer that is one form of an image forming apparatus as an embodiment of the present invention. The present invention, however, is not restricted to color laser printers, and is applicable to other image forming apparatuses such as monochromatic or other types of printers, copying machines, facsimiles, and MFPs of the foregoing.

The image forming apparatus illustrated in FIG. 1 includes an exposing unit 2, an image forming unit 3, an image transfer unit 4, a paper feeding device 5, a conveying path 6, a fixing unit 7, and a discharging unit 8.

The exposing unit 2 is positioned at an upper portion of the image forming apparatus 1 and includes a light source that emits light and various optical systems. In the exposing unit 2, beams of light for respective separated color components of an image created based on image data acquired from an image acquiring unit not depicted are emitted towards later described photosensitive elements in the image forming unit 3 and the surfaces of the photosensitive elements are exposed to form latent images on the respective surfaces of the photosensitive elements.

The image forming unit 3 is positioned below the exposing unit 2 and includes a plurality of image forming units 31 structured to be detachable with respect to the main body of the image forming apparatus 1. Each of the image forming units 31 includes a photosensitive drum 32 as an image carrier that is capable of carrying toner as developer on the surface thereof, a roller charging device 33 that uniformly charges the surface of the photosensitive drum 32, a developing device 34 that supplies toner to the surface of the photosensitive drum 32, and a photosensitive-drum cleaning blade 35 that cleans the surface of the photosensitive drum 32. The image forming units 31 are composed of four image forming units 31 (31Y, 31C, 31M, 31Bk) corresponding to different colors of yellow, cyan, magenta, and black that are the separated color components of a color image, and are of the same structure except for the color of toner, and thus their redundant explanations are omitted.

The image transfer unit 4 is positioned immediately below the image forming unit 3. The image transfer unit 4 includes a transfer belt 43 that extends between a drive roller 4*a* and a driven roller 4*b* to revolve around the foregoing, a belt cleaning device 44 that cleans the surface of the transfer belt 43, and primary transfer rollers 45 that are disposed at positions opposite to the respective photosensitive drums 32 across the transfer belt 43. Each of the primary transfer rollers 45 presses the inner circumferential surface of the transfer belt 43 at the respective positions, and this pressing force forms a primary transfer nip between each of the photosensitive drums 32 and the respective primary transfer rollers 45.

Furthermore, at a position facing the drive roller 4*a*, a secondary transfer roller 46 is disposed. The secondary transfer roller 46 presses the outer circumferential surface of the transfer belt 43, and between the drive roller 4*a* and the secondary transfer roller 46, a secondary transfer nip is formed. Below the transfer belt 43, disposed is a waste toner container 47 that stores waste toner cleaned by the belt cleaning device 44. The waste toner removed by the belt cleaning device 44 is transferred to the waste toner container 47 via a waste-toner transfer hose not depicted.

The paper feeding device 5 is positioned at a lower portion of the image forming apparatus 1 and includes a paper feed tray 51 that stores therein recording paper P and a paper feeding roller 52 that takes out the recording paper P from the paper feed tray 51. The structure of the paper feeding device 5 in detail will be described later.

The conveying path 6 is a conveying route to convey the recording paper P taken out from the paper feeding device 5, and other than a pair of registration rollers 61, pairs of carriage rollers not depicted are appropriately disposed along the conveying path 6 reaching the discharging unit 8 described later.

The fixing unit 7 is positioned downstream of the secondary transfer nip on the conveying route, and includes a fixing roller 72 that is heated up by a heat source 71, and a pressing roller 73 that applies pressure on the fixing roller 72.

The discharging unit 8 is provided at the most downstream of the conveying path 6 in the image forming apparatus 1, and includes a pair of discharging rollers 81 that discharges the recording paper P to the outside and a discharge tray 82 that stocks the recording medium discharged.

With reference to FIG. 1, the following describes the basic operation of the above-described image forming apparatus.

In the image forming apparatus, when an image forming operation is started, the photosensitive drum 32 of each of the image forming units 31Y, 31C, 31M, and 31Bk is rotary driven by a driving device (not depicted) clockwise in FIG. 1, and the surface of the photosensitive drum 32 is uniformly charged in a given polarity by the roller charging device 33. The surface of each photosensitive drum 32 charged is irradiated with a laser beam of each color component for an image to be formed from the exposing unit 2, and on the surface of the photosensitive drum 32, an electrostatic latent image is formed. At this time, the image information to which each photosensitive drum 32 is exposed is the image information of a single color that is created by breaking down a desired full color image into the color information of yellow, cyan, magenta, and black. The electrostatic latent image thus formed on the photosensitive drum 32 is supplied with toner from the respective developing devices 34 to visualize the electrostatic latent image as a toner image (developer image) that is a visible image.

Then, the drive roller 4*a* of the image transfer unit 4 rotates counter-clockwise in FIG. 1 and drives the transfer belt 43 to travel in the direction indicated by an arrow D in FIG. 1. Furthermore, a constant voltage or a constant-current controlled voltage in a polarity opposite to the charged polarity of the toner is applied to each of the primary transfer rollers 45. This forms a transfer electric field at the primary transfer nip between each of the primary transfer rollers 45 and the respective photosensitive drums 32. The toner image in each color formed on the respective photosensitive drums 32 of the image forming units 31Y, 31C, 31M, and 31Bk is then transferred onto the transfer belt 43 in sequence in a superposed manner by the respective transfer electric fields formed at the above-described primary transfer nips. On the surface of the transfer belt 43, a toner image in full color is thus formed.

Thereafter, the residual toner adhered on the surface of each photosensitive drum 32 is removed by the photosensitive-drum cleaning blade 35, and the surface is then neutralized by a neutralization device not depicted to initialize the surface potential thereof so as to prepare for subsequent image forming.

Meanwhile, when the image forming operation is started, at the lower portion of the image forming apparatus, the paper feeding roller 52 of the paper feeding device 5 rotates to drive and drives out the recording paper P stored in the paper feed tray 51 onto the conveying path 6. The registration rollers 61 convey the recording paper P driven out onto the conveying path 6 to the secondary transfer nip at a given timing. At this time, a transfer voltage in a polarity opposite to the charged polarity of the toner of the toner image formed on the transfer belt 43 is applied to the secondary transfer roller 46 to form the transfer electric field at the secondary transfer nip. By this transfer electric field, the toner image on the transfer belt 43 is then collectively transferred onto the recording paper P.

The recording paper P on which the toner image is transferred is conveyed to the fixing unit 7, and is heated by the fixing roller 72, which is heated up by the heat source 71, and pressed by the pressing roller 73, whereby the toner image is fixed onto the recording paper P. The recording paper P on which the toner image is fixed is conveyed by the pairs of carriage rollers not depicted, after being separated from the fixing roller 72, and discharged to the discharge tray 82 by the discharging rollers 81 in the discharging unit 8. Meanwhile, the residual toner adhering to the transfer belt 43 after the transfer is removed by the belt cleaning device 44, and is conveyed by a screw, the waste-toner transfer hose, and the like to the waste toner container 47 to be collected.

While the above description is of the image forming operation when a full color image is formed on the recording paper P, it is possible to form a single color image using any one of the four image forming units 31Y, 31C, 31M, and 31Bk, or to form a two- or three-color image using two or three image forming units 31, respectively. Furthermore, examples of the recording media include, other than plain paper, heavy paper, postcards, envelopes, thin paper, coated paper (coat paper, art paper, and such), tracing paper, and viewgraphs used for an overhead projector (OHP).

The following describes a first embodiment of the paper feeding device 5 that is characteristic of the present invention.

Figure 2:
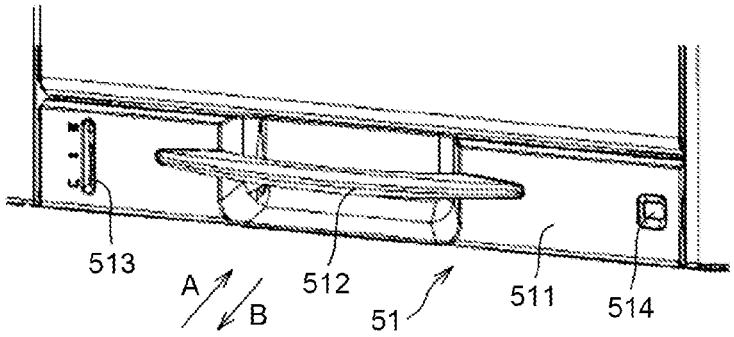
FIG. 2 is a perspective view of the main body of the image forming apparatus viewed from the front.

The paper feed tray 51 as a media storage unit is, as illustrated in FIG. 2, attached to or detached from the main body of the image forming apparatus 1 via an opening provided on the front (on the right side in FIG. 1) of the main body of the image forming apparatus 1. In FIG. 2, an arrow A indicates the attaching direction of the paper feed tray 51, and an arrow B indicates the detaching direction thereof (the same applies to the following descriptions). On a front panel 511 of the paper feed tray 51, a handle 512 is formed for a user to take hold when the paper feed tray 51 is attached or detached. On a side portion of the front panel 511 on one side, a remaining-quantity display window 513 that displays the remaining quantity of paper in the paper feed tray 51 is formed, and on a side portion on the other side, a size display window 514 that displays paper size stored in the paper feed tray 51 is formed. It is desirable that a circumferential portion 514*a* of the size display window 514 be formed in a beveled manner to improve visibility (see FIG. 3).

Figure 3:
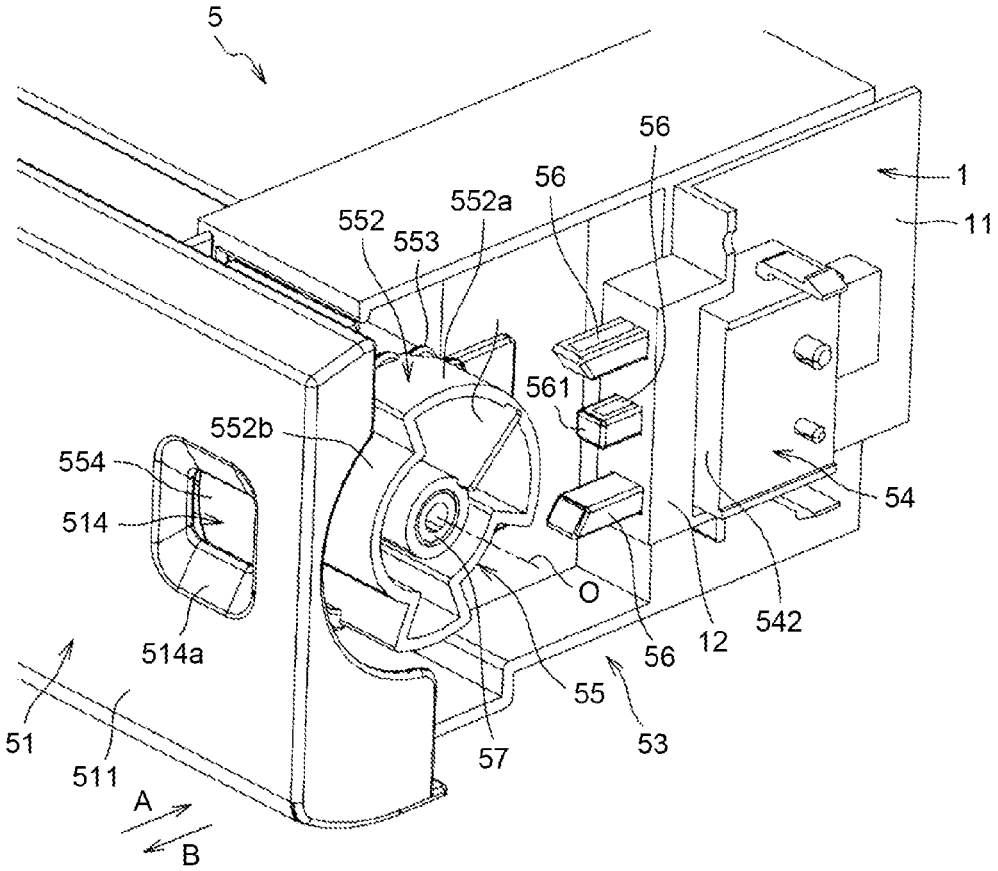
FIG. 3 is a perspective view illustrating a structure of the feeding device according to a first embodiment.

FIG. 3 is a perspective view illustrating a state immediately before the paper feed tray 51 is pushed ahead to a given attaching position after being inserted to the opening of the main body of the image forming apparatus 1 when the paper feed tray 51 is attached to the main body of the image forming apparatus 1. As illustrated in FIG. 3, out of the paper feeding device 5, on the side portion of the paper feed tray 51 on the other side, an encoding module 53 that encodes the size of paper stored in the paper feed tray 51 is provided. The paper size encoded by the encoding module 53 is transmitted to a not depicted controller in the main body of the image forming apparatus 1. The controller controls the respective units of the image forming apparatus based on the information so as to perform copying or printing tailored to the paper size.

The encoding module 53 includes a detector 54 as a sensor, a control member 55, spacers 56 disposed between the detector 54 and the control member 55, and a holding mechanism 58 (a restricting mechanism) (see FIG. 5) that holds the control member 55 at predetermined rotation angles. The following describes the structure of the foregoing in series.

Figure 4:
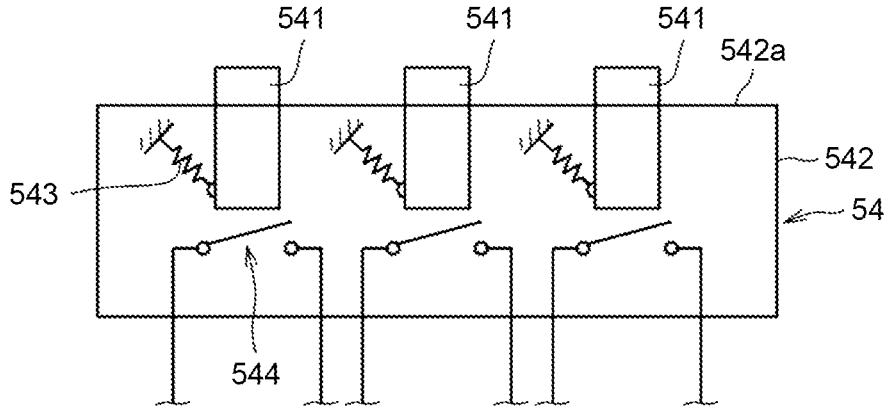
FIG. 4 is a sectional view schematically illustrating a structure of a detector.
Figure 6:
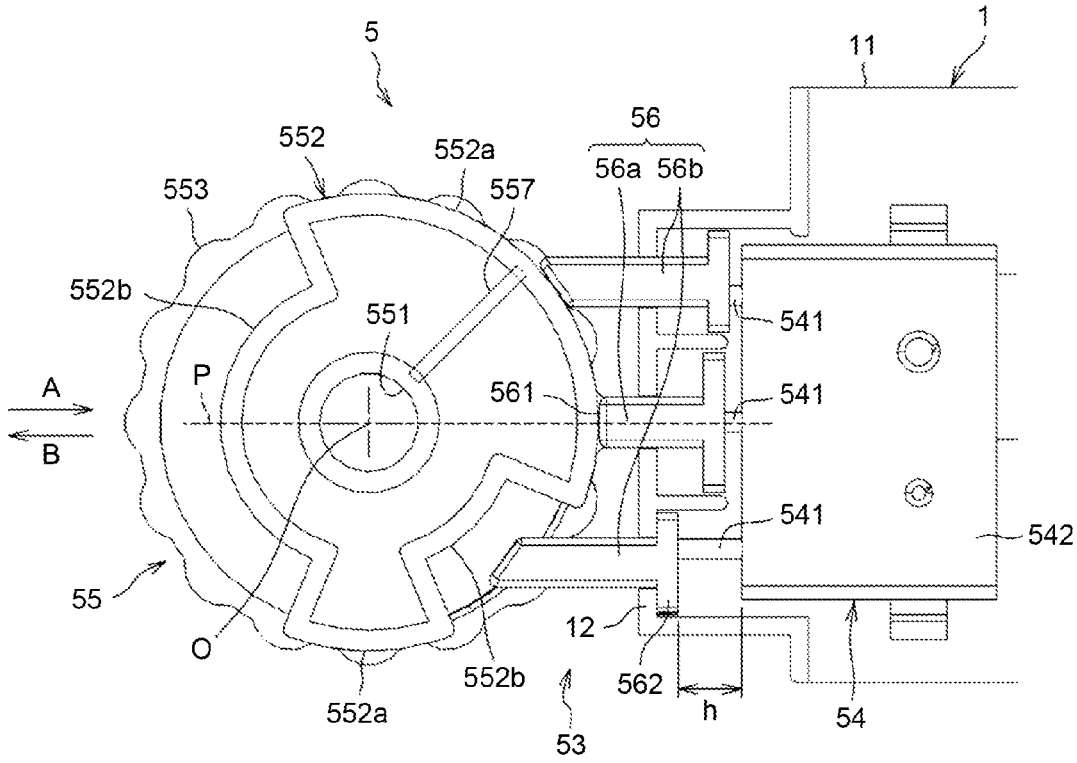
FIG. 6 is a side view of the feeding device.

The detector 54 includes, as illustrated in FIG. 6, a plurality of movable pieces 541 (three pieces in the first embodiment) lined up in a row. The detector 54 is attached to a frame 11 (see FIG. 3) of the main body of the image forming apparatus 1 with each of the movable pieces 541 disposed to face a later described control surface 552 of the control member 55. As schematically illustrated in FIG. 4, the movable pieces 541 are movable between a position projecting with respect to a holder 542 and a position retracted in the holder 542. Each of the movable pieces 541 is biased at all times in a direction to project from a holder front face 542*a* by the biasing force of an elastic member 543 disposed in the holder 542. Thrusting the movable piece 541 resisting against the biasing force can retract the movable piece 541.

In the moving area of each movable piece, a contact point 544 that is biased in a direction to open a circuit is disposed. When the movable piece 541 retracts, the contact point 544 that is in contact with the movable piece 541 closes. When the movable piece 541 projects, the contact point 544 opens up. Each of the contact points 544 is electrically connected to the controller in the main body of the image forming apparatus 1.

Figure 5:
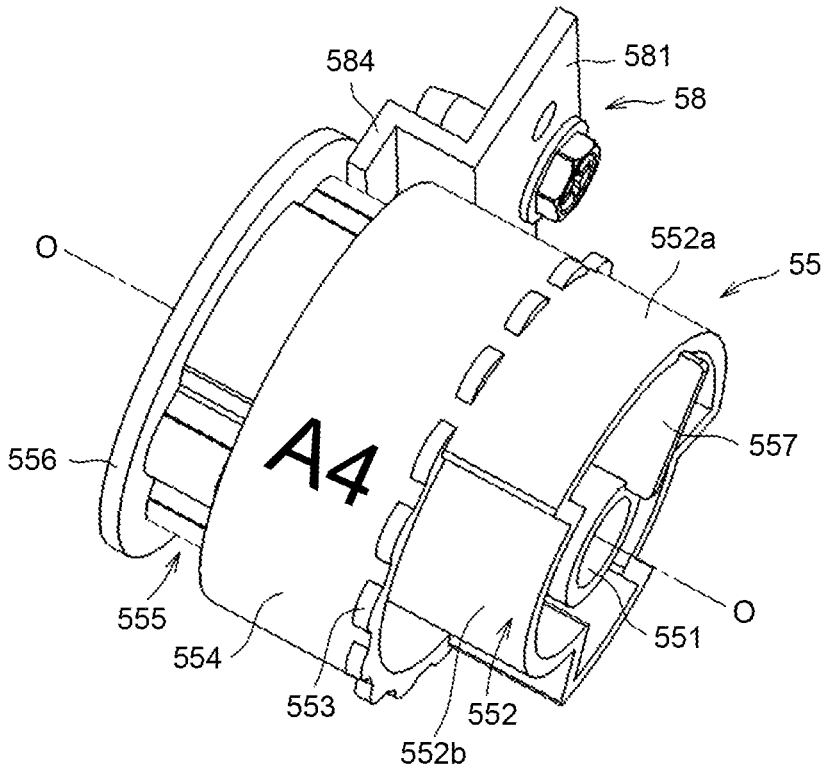
FIG. 5 is a perspective view of a control member and a holding mechanism.

As illustrated in FIGS. 3 and 5, the control member 55 is in a roughly cylindrical shape having a through-hole 551 in the axial direction thereof, and is formed of, for example, resin. Fitting the through-hole 551 to a boss 57 outwardly projecting on the side surface of the paper feed tray 51 makes the paper feed tray 51 support the control member 55 rotatably. The rotational axis O of the control member 55 extends in a horizontal direction orthogonal to the attaching and detaching directions (arrow A and arrow B directions) of the paper feed tray 51. The control member 55 is rotated by the user to be at a given rotation angle (phase).

On the outer circumferential surface of the end portion of the control member 55 on the outer side, formed is the control surface 552 composed of recessed portions 552*b* and a plurality of projecting portions 552*a* projecting in the radial direction with respect to the recessed portions 552*b*. In a state of the paper feed tray 51 attached to the main body of the image forming apparatus 1, the control surface 552 faces the detector 54 in the direction of attaching (arrow A direction) the paper feed tray 51. In the first embodiment, the outer circumferential surfaces of the projecting portions 552*a* are formed in a cylindrical surface shape around the rotational axis O, and thus the curvature radius of the outer circumferential surface of the projecting portions 552*a* is equal to the radius of rotation thereof. The lengths of the projecting portions 552*a* in the circumferential direction and the number of the projecting portions 552*a* are determined according to the number of types of paper size to be encoded. In the first embodiment, exemplified is the control surface 552 provided with two projecting portions 552*a* and two recessed portions 552*b*. It is sufficient when a minimum of one projecting portion 552*a* and one recessed portion 552*b* are present on the control surface 552.

The inner diameter side of the control surface 552 is hollowed. In the hollow portion, provided are a cylindrical portion on the outer diameter side that forms the control surface 552, and a rib 557 extending in the radial direction over to a cylindrical portion on the inner diameter side that forms the through-hole 551. The user can rotate the control member 55 by catching the rib 557 with his/her finger inserted in the hollow portion.

As illustrated in FIG. 5, on the outer circumferential surface of the control member 55 on the inner side than the control surface 552, a plurality of protrusions 553 are formed at an equal pitch in the circumferential direction. The protrusions 553 can serve as slip stoppers for the finger when rotating the control member 55.

On the outer circumferential surface of the control member 55 on the inner side than the protrusions 553, a size display surface 554 is provided in a cylindrical surface shape. On the size display surface 554, letters and graphics that indicate standardized size names (such as A3 and A4) and paper conveying directions (portrait orientation and landscape orientation) are depicted as the paper size at a plurality of locations in the circumferential direction thereof. The size display surface 554 is at the position facing the size display window 514 provided on the front panel 511 of the paper feed tray 51, and thus the paper size depicted on the size display surface 554 is visible from the outside through the size display window 514.

Figure 7:
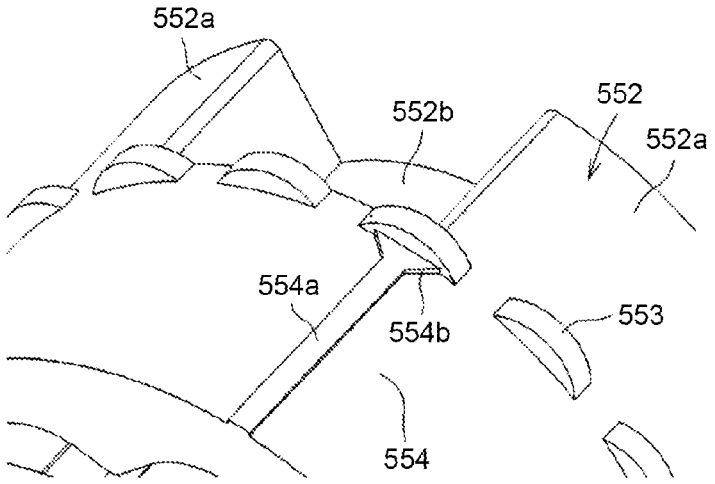
FIG. 7 is an enlarged perspective view of a part of the control member.

The paper sizes (letters and graphics) on the size display surface 554 can be depicted by pasting a decal on the outer circumferential surface, other than directly forming on the outer circumferential surface of the control member 55 by such means of molding and printing. As illustrated in FIG. 7, when a ridge 554*a* (or alternatively, a groove) that extends in the axial direction is formed on the size display surface 554, the entire decal can be pasted on the size display surface 554 by aligning one end of the decal with the ridge 554*a* first, thereby preventing a positional deviation in the circumferential direction between the display of the paper size on the size display surface 554 and the projecting portions 552*a* or the recessed portions 552*b* of the control surface 552, and thus reducing an assembly error. As illustrated in FIG. 7, when the shape of the ridge 554*a* is made to be asymmetrical in the axial direction, for example, by forming inclined surfaces 554*b* on one end of the ridge 554*a* in the axial direction, an error in the pasting direction of the decal can be prevented, and a further reduction in assembly error can be achieved.

Figures 8, 9:
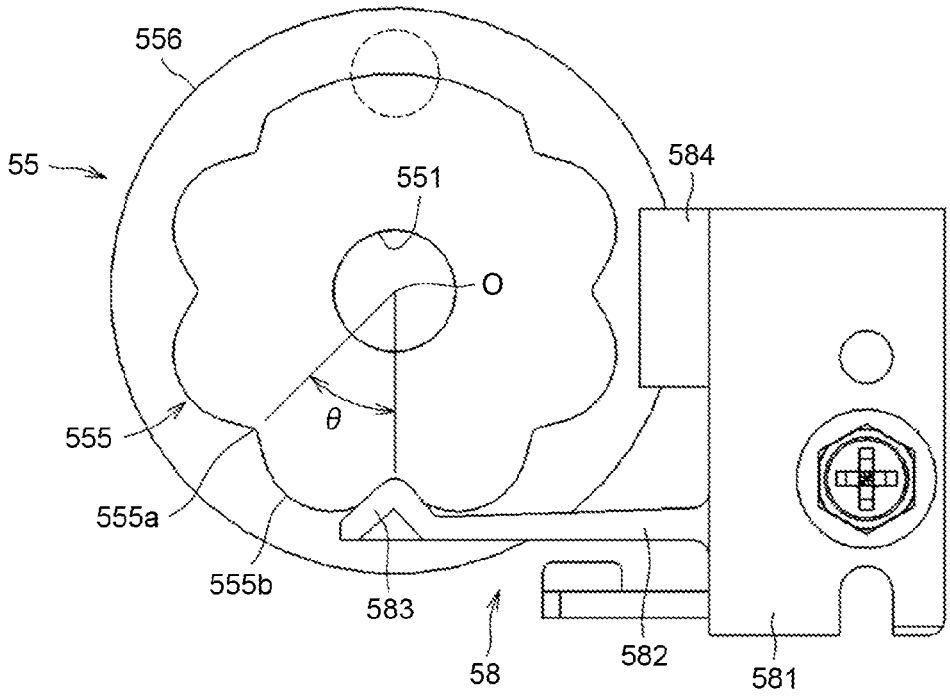
FIG. 8 is a sectional view of the holding mechanism.
FIG. 9 is a table illustrating the relation of on/off pattern of movable pieces and paper size.

On the outer circumferential surface of the control member 55 on the inner side than the size display surface 554, a restricting portion 555 constituting a part of the holding mechanism 58 described later is formed. As illustrated in FIG. 8, at a plurality of locations of the restricting portion 555 in the circumferential direction, trough portions 555*a* that serve as an engaging portion of the holding mechanism 58 are formed. The trough portion 555*a* can be formed, for example, with a smooth concave curve. Between the neighboring trough portions 555*a*, a crest portion 555*b* formed with a smooth convex curve is formed. As illustrated in FIG. 5, a maximum outer diameter of the crest portions 555*b* is smaller than the outer diameter of the size display surface 554.

Furthermore, on the outer circumferential surface of the control member 55 on the inner side than the restricting portion 555, a flange 556 is formed.

While the control member 55 is exemplified to include, as illustrated in FIG. 5, from the outer side towards the inner side in the axial direction, the control surface 552, the protrusions 553, the size display surface 554, the restricting portion 555, and the flange 556 in series in the above description, the disposed positions of the respective portions 552 to 556 can be substituted with one another as necessary. For example, the flange 556 can be provided between the size display surface 554 and the restricting portion 555.

Next, the spacers 56 will be described. As illustrated in FIG. 6, the spacers 56 are members of an elongated shape, and are disposed between the respective movable pieces 541 of the detector 54 and the control surface 552 of the control member 55 with the longitudinal direction thereof oriented in the attaching and detaching directions of the paper feed tray 51 (arrow A direction and arrow B direction). Each of the spacers 56 is slidable in a direction parallel to the attaching and detaching directions of the paper feed tray 51 while being guided by a guide portion 12 provided on the main body of the image forming apparatus 1.

Leading end faces 561 of the respective spacers 56 are formed in a shape to fit the outer circumferential surface of the projecting portion 552*a* when the leading end faces 561 are made to contact the projecting portion 552*a* of the control member 55. More specifically, with a spacer 56*a* that is located on an extended line P of the movement locus of the rotational axis O when the paper feed tray 51 is attached or detached, the leading end face is nearly perpendicular. With spacers 56*b* that are located away from the extended line P, the leading end face 561 has a tapered face in which the leading end face is further displaced in the direction of detaching the paper feed tray 51 (arrow B direction) as the leading end face is further away from the extended line P. With the above structure, when the leading end face 561 of the respective spacers 56 is made to contact the outer circumferential surface of the projecting portion 552*a* by attaching the paper feed tray 51, the both can practically be brought into surface contact. The spacers 56*b* on both ends can be made to be common components, whereby cost reduction can be achieved.

At the base end of the spacers 56, stoppers 562 are formed. The stoppers 562 contacting the guide portion 12 define the projecting positions of the respective spacers 56. In a state of the leading end face 561 of the spacer 56 facing the recessed portion 552*b* of the control surface 552, the spacer 56 is pressed by the movable piece 541 receiving the biasing force and thus moves towards the detaching direction of the paper feed tray 51 (arrow B direction). Consequently, the spacer 56 and the movable piece 541 reach the projecting position as a first position (see the lower spacer 56*b* in FIG. 6), and the contact point 544 corresponding to the movable piece 541 is in an open (off) state. In this state, the leading end face 561 of the spacer 56 is in a noncontact state with respect to the outer circumferential surface of the recessed portion 552*b*.

On the other hand, in a state of the leading end face 561 of the spacer 56 facing the projecting portion 552*a* of the control surface 552, along with the attaching of the paper feed tray 51, the spacer 56 receives pressing force from the projecting portion 552*a* and thus retracts towards the attaching direction of the paper feed tray 51 (arrow A direction), and in addition, the movable piece 541 retracts. Consequently, the spacer 56 and the movable piece 541 reach the retracted position as a second position, and the contact point 544 corresponding to the movable piece 541 is in a closed (on) state.

As in the foregoing, in the first embodiment, the spacer 56 moves from the retracted position reaching the projecting position by the biasing force of the elastic member 543 disposed inside the detector 54. On the other hand, the spacer 56 moves from the projecting position reaching the retracted position by the pressing force received from the projecting portion 552*a*.

Next, the holding mechanism 58 will be described. The holding mechanism 58 is structured, as illustrated in FIG. 8, with the above-described restricting portion 555 of the control member 55 and a latching member 582 provided on the paper feed tray 51. The latching member 582 is projected from a base member 581 attached to the paper feed tray 51, and at the leading end portion thereof, a claw portion 583 is formed in a shape to fit the trough portion 555*a* of the restricting portion 555. The base member 581 and the latching member 582 are integrally formed of resin, for example, and the claw portion 583 of the latching member 582 is biased by the elasticity of the latching member 582 itself in the direction of the rotational axis O of the control member 55. In a state of the claw portion 583 fitted in the trough portion 555*a* as illustrated in FIG. 8, the claw portion 583 elastically engages with the trough portion 555*a* on both sides in the circumferential direction, and thus the forward and reverse rotation of the control member 55 is restricted and the control member 55 is fixed at a given rotation angle.

When the user rotates the control member 55 resisting against the elasticity of the latching member 582, the claw portion 583 escapes from the trough portion 555*a* and climbs over the crest portion 555*b* to fit in the neighboring trough portion 555*a*. When the rotation of the control member 55 is stopped at the time the claw portion 583 fits in any given trough portion 555*a*, the claw portion 583 of the latching member 582 is in a state of being engaged with the trough portion 555*a* on both sides in the circumferential direction and thus the control member 55 is fixed at a new rotation angle. Engaging the claw portion 583 with any given trough portion 555*a* in this manner can hold the control member 55 at a plurality of predetermined rotational angles. The top of the crest portion 555*b* is a smooth convex curve, and thus in a state of the claw portion 583 climbing on the crest portion 555*b*, the claw portion 583 slides down to either of the neighboring trough portions 555*a*. The control member 55 therefore is basically not held at an angle other than the defined rotation angles.

In the first embodiment, there are eight different paper sizes to be encoded as will be described later, and thus the central angle θ of the neighboring trough portions 555*a* of the restricting portion 555 is defined as θ=45° that is 360° divided into eight equal angles.

On the base member 581, a retainer 584 is attached. As illustrated in FIG. 5, making the retainer 584 engage with the outer surface of the flange 556 provided on the end portion of the control member 55 on the inner side can prevent the control member 55 from coming off from the boss 57 (see FIG. 3).

The following describes a procedure, using the above-described paper feeding device 5, to encode the size of paper stored in the paper feed tray 51.

First, in a state of the paper feed tray 51 detached from the main body of the image forming apparatus 1, all of the spacers 56 and the movable pieces 541 are in projecting positions. Consequently, the contact points 544 (see FIG. 4) of the detector 54 are all in an off-state.

In the paper feed tray 51 in a state of being detached from the main body of the image forming apparatus 1, the control member 55 is held by the holding mechanism 58 at a certain rotation angle corresponding to a certain paper size. When the paper feed tray 51 is inserted into the opening on the front of the main body of the image forming apparatus 1, the leading end faces 561 of the respective spacers 56 face either one of the projecting portion 552*a* and the recessed portion 552*b* of the control surface 552 and the disposed pattern of the projecting portion 552*a* and the recessed portion 552*b* in the facing area with respect to the leading end faces 561 corresponds to the rotation angles at which the control member 55 is fixed. When the paper feed tray 51 is further pushed ahead to a given attaching position, the spacer 56 facing the projecting portion 552*a* and eventually the movable piece 541 corresponding to the spacer 56 receive the pressing force from the projecting portion 552*a* and are thrust in the attaching direction (arrow A direction), and thus the contact point 544 corresponding to the movable piece 541 switches to on. The spacer 56 facing the recessed portion 552*b* and the movable piece 541 corresponding thereto are not changed in position even after the paper feed tray 51 is thrust up to the attaching position, and thus the contact point 544 corresponding thereto remains to be off. When the control member 55 is rotated and held at any given rotation angle, the on/off pattern of all of the contact points 544 after the paper feed tray 51 is attached is unambiguously determined.

As a consequence, the paper size can be encoded, and from the on/off pattern of all of the contact points 544, the paper size can be specified. For example, out of the three movable pieces 541 illustrated in FIG. 6, when the contact points 544 corresponding to the upper movable piece 541 and the middle movable piece 541 are switched on and the contact point 544 corresponding to the lower movable piece 541 is switched off, it can be determined that the paper size is A4 in landscape orientation. The controller in the main body of the image forming apparatus after having determined the foregoing, controls the respective units of the image forming apparatus based on the determination result to commence a print job.

The total number of combinations of on/off patterns for the three contact points 544 is 2^3 combinations (eight combinations). Consequently, with the structure in the first embodiment, a total of eight paper sizes can be encoded and thus the printing according to the respective paper sizes can be performed. FIG. 9 illustrates an example of the assignment of paper sizes for the on/off patterns of the respective contact points 544. Of the three movable pieces 541 illustrated in FIG. 6, the upper movable piece 541 is No. 1, the middle movable piece 541 is No. 2, and the lower movable piece 541 is No. 3. Furthermore, "1" in FIG. 6 represents that the contact point 544 is on, and "0" represents that the contact point 544 is off. Moreover, the letter T added to the standard paper sizes (such as A4 and A3) represents that the longitudinal direction of paper is parallel to the conveying direction (portrait orientation) and the letter Y represents that the lateral direction of paper is parallel to the conveying direction (landscape orientation).

In the size display window 514 of the paper feed tray 51, the paper size corresponding to the respective rotation angles of the control member 55 is displayed. Consequently, the paper size that the controller recognizes and the paper size visually displayed to the outside can be matched, and this allows the user to recognize which paper size the paper feed tray 51 is currently adopted. Furthermore, as illustrated in FIG. 9, when the paper of a non-standard size is also used, the letter "*", for example, is depicted on the size display surface 554 and is made to display in the size display window 514.

In the first embodiment, the state in which all of the contact points 544 are off (all of the spacers 56 are in a projecting state) is determined as the paper feed tray 51 not being attached, and that state is displayed on an operation screen and such (not depicted) of the main body of the image forming apparatus 1 to alert the user. This makes a dedicated sensor to detect the presence of the paper feed tray attached unnecessary, and thus cost reduction can be achieved.

In this case, all of the contact points 544 being off is not only when the paper feed tray is not attached. All of the contact points 544 are off also when all of the spacers 56 (the movable pieces 541) face the recessed portion 552*b*. When the paper feed tray 51 is attached to the main body of the image forming apparatus 1 in this state, it is therefore determined as no paper feed tray present even after the paper feed tray 51 is attached, resulting in a false detection.

To prevent such a failure, it is desirable that, at the rotation angle in which all of the spacers 56 (the movable pieces 541) face the recessed portion 552*b* of the control surface 552, the control member 55 be allowed to rotate without activating the holding mechanism 58. More specifically, as illustrated in FIG. 8, the trough portion 555*a* that is an engaging portion is not provided in the area of the restricting portion 555 (an area indicated by the dashed line in FIG. 8) in which the claw portion 583 of the latching member 582 makes contact when the control member 55 is fixed at the rotation angle in which all of the spacers 56 (the movable pieces 541) face the recessed portion 552*b* of the control surface 552, but the area is formed, for example, in a cylindrical surface shape centering around the rotational axis O. This prevents the situation of the control member 55 being held at such a rotation angle and allows the control member 55 to rotate, and thus the false detection as in the foregoing can be avoided.

In contrast to the foregoing, when a structure to detect the presence of the paper feed tray 51 attached with a dedicated sensor is adopted, the pattern of all of the contact points 544 being off can be used for the detection of paper size, whereby the number of types of media size usable can be increased. In this case, in the holding mechanism 58 illustrated in FIG. 8, it is necessary to further provide the trough portion 555*a* as an engaging portion in the area formed with the cylindrical surface (the location indicated by the dashed line circle), and to restrict the rotation of the control member 55 even at the rotation angle in which all of the spacers 56 (the movable pieces 541) face the recessed portion 552*b* of the control surface 552.

The feeding device of the present invention thus structured has the following effects.

The control surface 552 is formed on the outer circumferential surface of the control member 55, and each of the movable pieces 541 is disposed to face the control surface 552, and thus the control member 55 can be made compact. More specifically, different from a case in which the control surfaces having projections and recesses are formed at a plurality of locations in the axial direction of the control member 55, the control surface 552 only needs to be formed at a single location in the axial direction, and thus the dimension of the control member 55 in the axial direction can be shortened to make the control member 55 compact. Consequently, the occupying space of the encoding module 53 can be made small and the degree of freedom in the layout thereof can be improved. Furthermore, a general-purpose item having the movable pieces 541 in a single row is usable as the detector 54, and thus cost reduction can be achieved.

The control member 55 is supported in a state of being fitted on the boss 57 (see FIG. 3), and thus the control member 55 has some play. Consequently, if the area of contact between the projecting portion 552*a* of the control surface 552 and the member on the detector 54 side which contacts the projecting portion 552*a* (the spacer 56 in the first embodiment) is small, the fluctuation in the amount of thrust of the movable piece 541 may arise and may thus pose a problem in correctly switching the contact point 544 on and off. In contrast, in the present invention, the outer circumferential surface of the projecting portion 552*a* is formed in a shape (cylindrical surface shape) having a curvature radius that is equal to the radius of rotation of the projecting portion 552*a*, and thus the area of contact between the projecting portion 552*a* and the spacer 56 can be increased and the fluctuation in the amount of thrust of the movable piece by the influence of the play of the control member 55 can be reduced. Consequently, the contact point 544 can be switched accurately and the reliability of the image forming apparatus can be improved.

Such effects can be similarly achieved when the outer circumferential surface of the projecting portion 552*a* is formed in a cylindrical surface shape the curvature radius of which is larger than the radius of rotation. Furthermore, similar effects can be achieved when the outer circumferential surface of the projecting portion 552*a* is formed to be planar the curvature radius of which is infinity (see a second embodiment). When the outer circumferential surface of the projecting portion 552*a* is made to be planar, the outer circumferential surface can reliably be brought into surface contact with the leading end face 561 of the spacer 56, and thus the fluctuation in the amount of thrust of the movable piece by the influence of the play of the control member 55 can be reduced more effectively.

Each of the movable pieces 541 is movable between the projecting position (first position) and the retracted position (second position), and each of the movable pieces 541 is moved from the projecting position to the retracted position by the pressing force received from the projecting portion 552*a* and is moved from the second position to the first position by the biasing force of the elastic member 543 provided on the detector 54, and furthermore, each of the contact points is switched off when its corresponding movable piece is at the first position, and is switched on when its corresponding movable piece is at the second position. This allows the detector 54 having a general-purpose structure and function to be used, and thus the media size can be encoded in a simple structure.

When the controller determines that the paper feed tray 51 is not attached in a state of all of the contract points being off, a dedicated sensor to detect the presence of the paper feed tray 51 attached is unnecessary. Consequently, the number of components can be reduced and a further cost reduction can be achieved.

Providing the holding mechanism (restricting mechanism) 58 that restricts the rotation of the control member 55 at respective rotation angles can prevent the false detection resulting from the control member 55 stopping at other than a given rotation angle. When all of the contact points 544 being off is determined as the paper feed tray 51 being not attached as in the foregoing, the holding mechanism 58 is not activated at the rotation angle in which all of the movable pieces 541 are at the projecting position. This can prevent the false detection of the paper feed tray 51 being not attached even though the paper feed tray 51 is already attached.

The holding mechanism 58 can be structured with the trough portions 555*a* (engaging portion) provided at a plurality of locations on the outer circumferential surface of the control member 55 and the latching member 582 provided on the paper feed tray 51 and elastically engageable with the trough portion 555*a* in the circumferential direction. This simplifies the structure of the holding mechanism 58. In this example, when the latching member 582 is made to press the trough portion 555*a* by the elasticity of the latching member 582 itself, it makes it unnecessary to separately attach an elastic member to the latching member 582, and thus the structure of the holding mechanism 58 can be further simplified.

Figure 15:
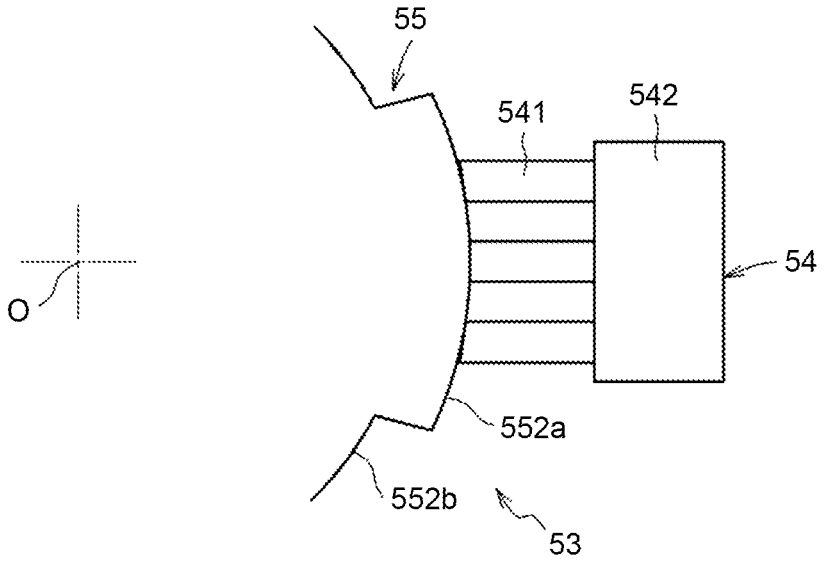
FIG. 15 is a side view schematically illustrating a feeding device in another embodiment.

In the present invention, between the control member 55 and each of the movable pieces 541 of the detector 54, disposed are the respective spacers 56 that make contact with the outer circumferential surface of the projecting portion 552*a* and are movable in conjunction with the corresponding movable piece 541 in the attaching and detaching directions of the paper feed tray 51. When the spacers 56 are omitted, the movable pieces 541 of the detector 54 are to contact the projecting portion 552*a* of the control member 55 as illustrated in FIG. 15. However, with a general-purpose detector, the heights h of the movable pieces (see FIG. 6) are constant, and when used as they are, the amount of thrust thus has different values according to the offset distance of the movable piece 541 with respect to the extended line P. Consequently, when the amount of thrust is set with reference to the movable piece 541 close to the extended line P, a shortage in the amount of thrust results with the movable pieces 541 away from the extended line P, and when the amount of thrust is set with reference to the movable piece 541 away from the extended line P, an excess in the amount of thrust results with the movable piece 541 close to the extended line P and a limit in the movable amount of the movable piece 541 may thus be exceeded. As illustrated in FIG. 15, while such a problem can be avoided when the movable pieces 541 are made to be different in length between a central portion and both sides, the detector 54 in which the lengths of the movable pieces 541 are different is not a general-purpose item, and thus it leads to a cost increase.

In contrast, the use of the spacers 56 enables the amount of thrust of the movable pieces 541 to be equal and a general-purpose item with the movable pieces 541 having an equal length to be used, and thus the above-described flaw can be avoided. When the above-described flaw is not particularly a problem due to the size of the image forming apparatus or the design capacity thereof, it does not matter if the spacers 56 are omitted and the movable pieces 541 are made to contact the projecting portion 552*a* of the control member 55 directly as illustrated in FIG. 15.

Forming the leading end face 561 of each of the spacers 56 in a shape to fit the outer circumferential surface of the projecting portion 552*a* can practically bring the spacer 56 and the outer circumferential surface of the projecting portion 552*a* into surface contact. This makes the contact state of the spacer 56 and the outer circumferential surface of the projecting portion 552*a* stabilized, and enables the encoding of media size to be performed accurately. More specifically, the leading end faces 561 of the spacers 56*b*, which are positioned away from the extended line of the movement locus of the rotational axis O of the control member 55 when the paper feed tray is attached, are formed in a shape that is further displaced in the direction of detaching the paper feed tray 51 as the leading end face is further away from the extended line. This enables the spacers 56 and the projecting portion 552*a* to be practically brought into surface contact.

Providing the size display surface 554 to display the media size of the recording medium stored in the paper feed tray 51 makes it easy to determine which paper size the current rotation angle of the control member 55 corresponds to.

The following describes a second embodiment of the present invention based on FIGS. 10 to 13. For the explanation of the encoding module 53 according to the second embodiment, only the members having different structures and functions from those in the first embodiment are described, and the members having the same structure and function as those in the first embodiment bear common reference numerals and their redundant explanations are omitted.

Figure 10:
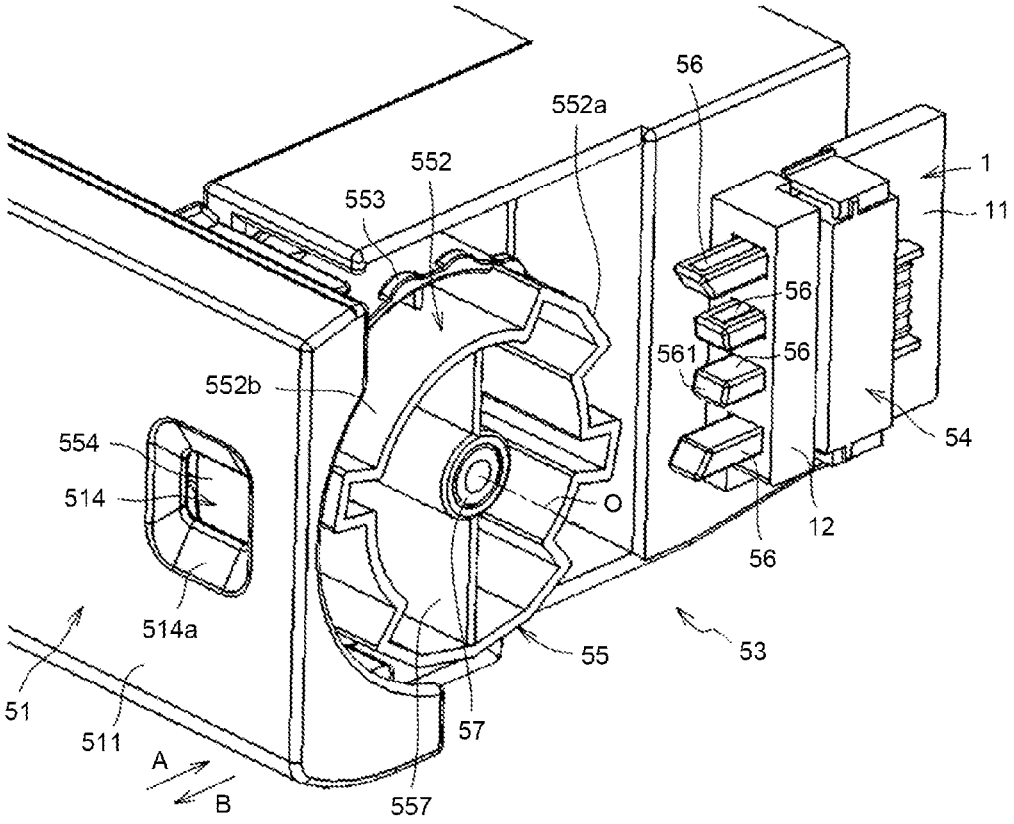
FIG. 10 is a perspective view illustrating a structure of a feeding device according to a second embodiment.
Figure 11:
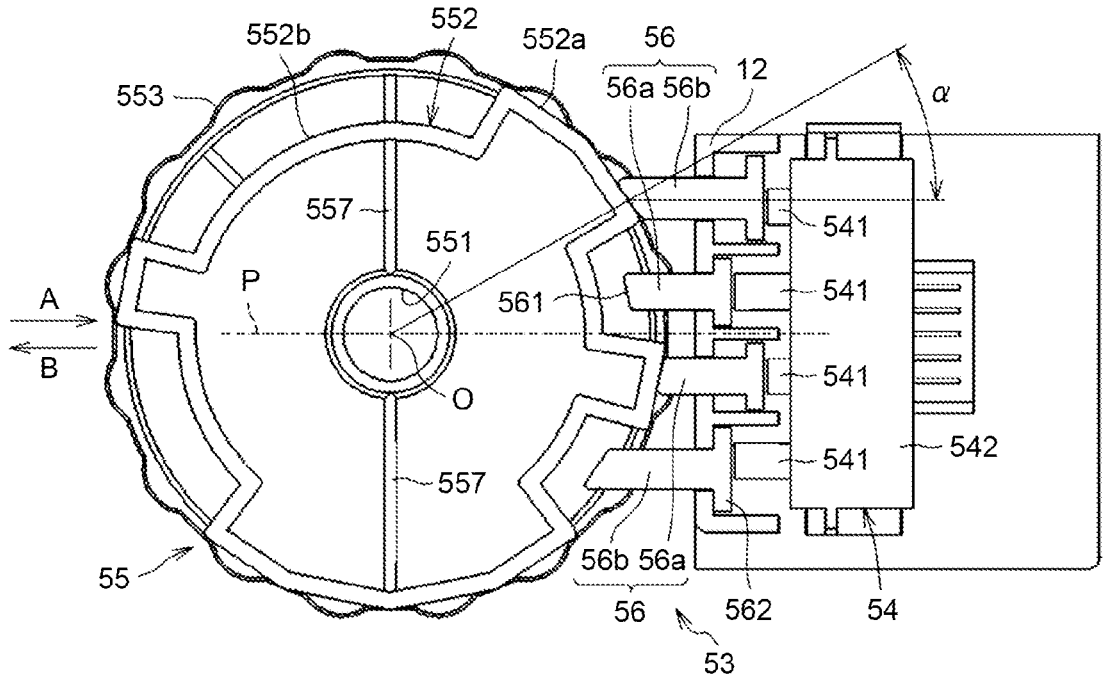
FIG. 11 is a side view of the feeding device.

As illustrated in FIGS. 10 and 11, the second embodiment is different from the first embodiment in point of the outer circumferential surface of the projecting portion 552*a* of the control member 55 being made planar as described above. The planar outer circumferential surface of the projecting portion 552*a* is so shaped that both ends thereof in the circumferential direction are inscribed in a cylindrical surface centering around the rotational axis O.

Figures 13, 14:
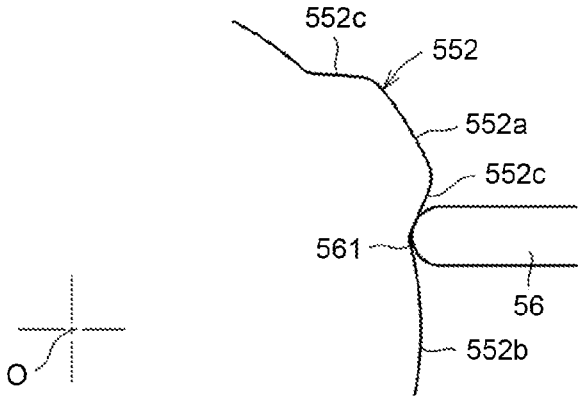
FIG. 13 is a table illustrating the relation of on/off pattern of movable pieces and paper size.
FIG. 14 is a side view schematically illustrating a control member and a spacer according to another embodiment.

Furthermore, in the second embodiment, a type of detector that has four pieces of the movable pieces 541 is used as the detector 54. The use of this detector 54 can encode 2^4 different paper sizes (16 paper sizes), and thus the number of types of paper size stored in the paper feed tray 51 is substantially increased. FIG. 13 illustrates an example of the assignment of paper sizes for the on/off patterns of the respective contact points 544. The meanings of 1, 0, T, and Y are common to those in FIG. 9. FIGS. 10 and 11 illustrate the control member 55 and the detector 54 when conveying A4 size paper in portrait orientation. In the second embodiment, the state in which all of the four contact points 544 are off (all of the spacers 56 are in a projecting state) can be determined as the paper feed tray 51 not being attached, and in this case, 15 different paper sizes can be determined.

The four pieces of the spacers 56 are symmetrically disposed in the up-and-down direction across the extended line P of the movement locus of the rotational axis O when the paper feed tray 51 is attached to or detached from the main body of the image forming apparatus 1. The leading end faces 561 of the respective spacers 56 are all formed in a tapered-surface shape to be brought into surface contact with the planar outer circumferential surface of the projecting portion 552*a*. The taper angle of the leading end faces 561 of the two spacers 56*a* in the middle out of the spacers 56 is greater than that of the leading end faces 561 of the spacers 56*b* on both ends. Making the two spacers 56*a* in the middle as common components and making the two spacers 56*b* on both ends as common components can achieve cost reduction.

When the number of the movable pieces 541 of the detector 54 is thus increased from that of the detector 54 in the first embodiment, the contact angle $\alpha$ in the contact portion between the projecting portion 552*a* and the spacer 56 (the angle formed by the line towards the contact portion from the rotational axis O and the center line of the movable piece 541 that passes the contact portion) tends to increase as illustrated in FIG. 11. When the contact angle $\alpha$ is greater than 45°, force to expand the spacer 56 is greater than the pressing force that acts on the spacer 56 in the attaching direction, and thus the spacer 56 and the guide portion 12 are likely locked. Consequently, it is necessary to design the outer diameter of the control member 55 to be somewhat greater than that of the control member 55 in the first embodiment such that the contact angles $\alpha$ for all of the spacers 56 are 45° or smaller. When the contact angle $\alpha$ exceeds 45° even with such a countermeasure, it is desirable that the outer circumferential surface of the projecting portion 552*a* be formed in a cylindrical surface shape centering around the rotational axis O similarly to the first embodiment to reduce the locking.

Figure 12:
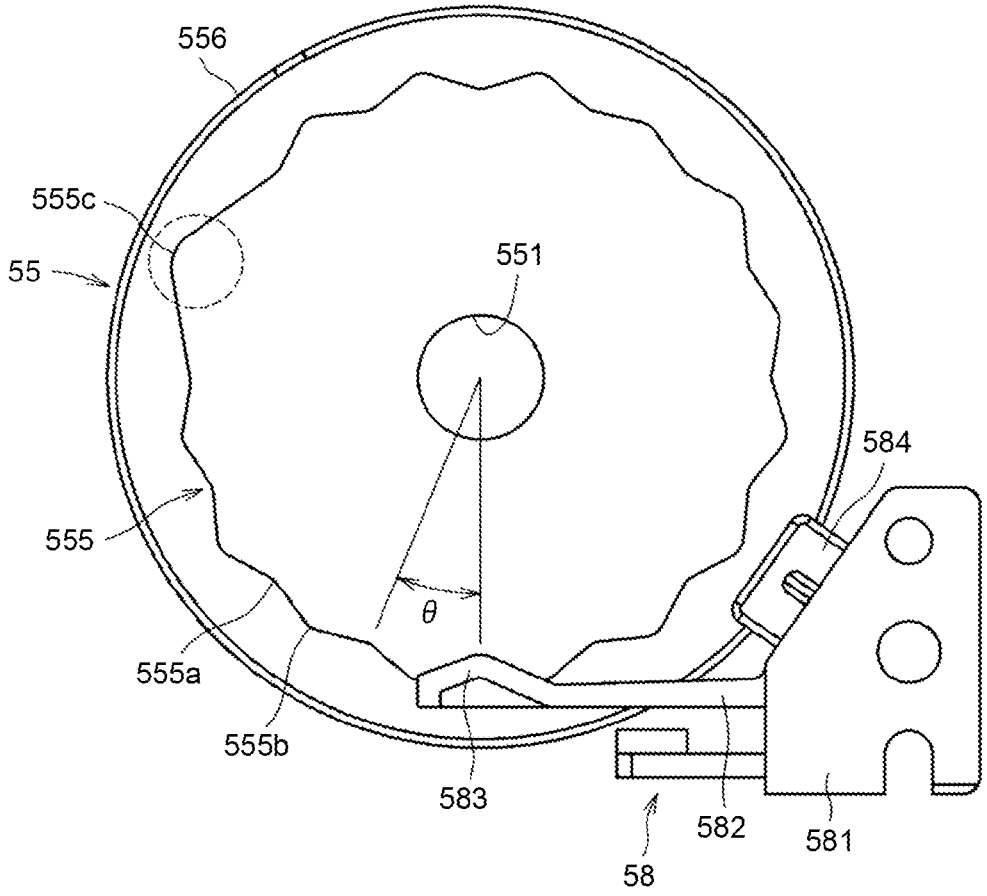
FIG. 12 is a sectional view of the holding mechanism.

FIG. 12 schematically illustrates the structure of the holding mechanism 58 in the second embodiment. With the encoding module 53 in the second embodiment, there are 16 paper sizes to be encoded, and thus the central angle θ between the neighboring trough portions 555*a* of the restricting portion 555 is defined as θ=22.5°. In the second embodiment, all of the contact points 544 being off is determined as no paper feed tray present, and thus in the area out of the restricting portion 555 in which the claw portion 583 of the latching member 582 makes contact with (an area indicated by the dashed line in FIG. 12) at the rotation angle of all of the contact points 544 being off, the trough portion 555*a* of the restricting portion 555 in the area is omitted and a projecting portion 555*c* is formed in the area to prevent a false detection. Similarly to FIG. 8, this area of the restricting portion 555 may be formed with a cylindrical surface. Moreover, in the first embodiment illustrated in FIG. 8, the portion in which the trough portion 555*a* is omitted can be formed with the projecting portion 555*c* similarly to FIG. 12.

In the first and second embodiments in the foregoing, when rotating the control member 55 in a state where the paper feed tray 51 is attached to the main body of the image forming apparatus 1, the control member 55 cannot be rotated smoothly because the spacer 56 catches the step surface between the projecting portion 552*a* and the recessed portion 552*b* of the control surface 552. In contrast, as illustrated in FIG. 14, when the step surface connecting the outer circumferential surface of the projecting portion 552*a* and the outer circumferential surface of the recessed portion 552*b* is formed in a gentle tapered-surface shape, and more preferably, the tip of the spacer 56 is further formed in a spherical surface shape that is not likely to interfere with the step surface, the control member 55 can be rotated even while the paper feed tray 51 is attached to the main body of the image forming apparatus 1. As a consequence, even in a state of the paper feed tray 51 attached to the main body of the image forming apparatus 1, the paper size can be changed.

The present invention can achieve the downsizing of and the lowering of the cost of a mechanism that encodes the media size of a recording medium. Consequently, a compact and low-cost image forming apparatus can be provided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A feeding device comprising:

a media storage unit that stores therein recording media and is attachable to and detachable from a main body of an image forming apparatus;

a detector that is provided on the main body of the image forming apparatus, includes a plurality of movable pieces and a plurality of contact points corresponding to the respective movable pieces, and switches to open or close each of the contact points in accordance with a position of the corresponding movable piece;

a control member that is rotatably supported by the media storage unit, includes a control surface on its outer circumferential surface with recessed portions and projecting portions provided in a direction of rotation, and is positioned at given rotation angles respectively corresponding to sizes of the recording media stored in the media storage unit, wherein the projecting portions and the recessed portions are disposed in a pattern corresponding to the rotation angles in an area of the control surface facing the movable pieces, and the control member controls the position of each of the movable pieces in accordance with the pattern so as to encode the media size, the control member is formed with the control surface on an outer circumferential surface thereof, each of the movable pieces is disposed to face the control surface, and an outer circumferential surface of each of the projecting portions is formed in a shape having a curvature radius greater than a radius of rotation thereof; and spacers that are disposed between the control member and each of the movable pieces of the detector, are capable of making contact with the outer circumferential surfaces of the projecting portions, and are movable in association with the corresponding movable pieces in directions of attaching and detaching the media storage unit, wherein a leading end face of each of the spacers is formed in a shape to fit the outer circumferential surface of the projecting portion and each of the spacers has a different shape.

2. The feeding device according to claim 1, wherein each of the movable pieces is movable between a first position and a second position, each of the movable pieces is moved from the first position to the second position by pressing force received from the projecting portions and is moved from the second position to the first position by biasing force, and each of the contact point is switched off when the corresponding movable piece is at the first position, and is switched on when the corresponding movable piece is at the second position.

3. The feeding device according to claim 2, wherein a state of all of the contact points being switched off indicates that no media storage unit is attached.

4. The feeding device according to claim 3, further comprising a restricting mechanism that restricts rotation of the control member at each of the rotation angles except for the rotation angle in which all of the movable pieces are at the first position.

5. The feeding device according to claim 1, further comprising a restricting mechanism that restricts rotation of the control member at each of the rotation angles.

6. The feeding device according to claim 4, wherein the restricting mechanism comprises engaging portions provided at a plurality of locations on the outer circumferential surface of the control member and a latching member provided on the media storage unit and elastically engageable with the engaging portions in a circumferential direction.

7. The feeding device according to claim 1, wherein a length of the spacer positioned away from an extended line of a movement locus of a rotational axis of the control member when the media storage unit is attached is made larger than the length of the spacer positioned close to the extended line of the movement locus.

8. The feeding device according to claim 1, wherein the leading end face of the spacer positioned away from the extended line of the movement locus of the rotational axis of the control member when the media storage unit is attached is displaced in a direction of detaching the media storage unit as the leading end face is further away from the extended line.

9. The feeding device according to claim 1, wherein the control member includes, on the outer circumferential surface thereof, a size display surface to display the media size of the recording media stored in the media storage unit.

10. The feeding device according to claim 1, wherein the outer circumferential surface of the projecting portion is formed in a cylindrical surface shape coaxial with a rotational axis of the control member.

11. The feeding device according to claim 1, wherein the outer circumferential surface of the projecting portion is formed in a planar surface shape.

12. An image forming apparatus comprising the feeding device according to claim 1.

13. The feeding device according to claim 5, wherein the restricting mechanism comprises engaging portions provided at a plurality of locations on the outer circumferential surface of the control member and a latching member provided on the media storage unit and elastically engageable with the engaging portions in a circumferential direction.

* * * * *